US006205733B1

(12) United States Patent
LaLonde

(10) Patent No.: US 6,205,733 B1
(45) Date of Patent: Mar. 27, 2001

(54) DIRECT MOUNT CEILING PANEL GRID SYSTEM

(75) Inventor: Paul Dennis LaLonde, Avon, OH (US)

(73) Assignee: USG Interiors, Inc., Chicago, IL (US)

( * ) Notice: Subject to any disclaimer, the term of this patent is extended or adjusted under 35 U.S.C. 154(b) by 0 days.

(21) Appl. No.: 09/361,951

(22) Filed: Jul. 27, 1999

(51) Int. Cl.[7] ..... E04B 9/00
(52) U.S. Cl. ..... 52/506.07
(58) Field of Search ..... 52/506.07, 506.08, 52/506.06, 506.05, 512, 235, 762, 764

(56) References Cited

U.S. PATENT DOCUMENTS

| | | | | |
|---|---|---|---|---|
| 2,059,483 | | 11/1936 | Parsons . | |
| 2,066,205 | * | 12/1936 | Keating | 52/506.07 X |
| 3,263,388 | | 8/1966 | Bogert . | |
| 3,339,329 | | 9/1967 | Berg . | |
| 3,857,216 | | 12/1974 | Sherman . | |
| 3,875,717 | | 4/1975 | Moeller . | |
| 3,969,865 | | 7/1976 | Andersen . | |
| 4,067,155 | | 1/1978 | Ruff et al. . | |
| 4,294,054 | | 10/1981 | Kuhr . | |
| 4,432,182 | | 2/1984 | Addie et al. . | |
| 4,720,946 | | 1/1988 | Pagliarello . | |
| 4,742,662 | * | 5/1988 | Smith | 52/506.07 X |
| 4,848,054 | * | 7/1989 | Blitzer et al. | 52/506.07 |
| 4,926,606 | | 5/1990 | Hanson . | |
| 5,265,393 | * | 11/1993 | Bischel et al. | 52/506.07 X |
| 5,611,185 | | 3/1997 | Wilz . | |
| 5,732,521 | | 3/1998 | Schmitt-Raiser . | |
| 5,768,843 | | 6/1998 | Dziedzic . | |
| 5,784,847 | | 7/1998 | Wiklund . | |

OTHER PUBLICATIONS

ACP Snap Tight Grid Brochure and Specification, Accoustic Ceiling Products, LLC, date unknown.

* cited by examiner

*Primary Examiner*—Jerry Redman
(74) *Attorney, Agent, or Firm*—Lee, Mann, Smith, McWilliams, Sweeney & Ohlson; John M. Lorenzen; David F Janci

(57) ABSTRACT

A direct mount ceiling grid system comprising a plurality of base grid members, cross grid members, and channel grid members for mounting ceiling panels close to a mounting surface. The base grid members are elongated T-shaped beams having a base flange and a transversely extending web having a thicker bulb portion at its marginal end. The base flange of each base grid member is directly mounted to a mounting surface. The channel grid members are elongated beams having two parallel transversely extending webs forming a channel therebetween. Upon installation of ceiling panels, the channel of the channel grid members removably engage the bulb portion of the transversely extending web of the base grid members. The channels have hook portions of the parallel webs of the channel grid members and deflect to allow capture of the bulb portion. The base flange of the base grid members and the base flange of the channel grid members capture the ceiling panels placed therebetween. The ceiling panels are also supported by the base flange of one or more cross grid members.

12 Claims, 5 Drawing Sheets

DIRECT MOUNT CEILING PANEL GRID SYSTEM

BACKGROUND OF THE INVENTION

The present invention relates to ceiling grid systems, which are typically constructed using "T" grid beams, joined to form a supporting grid system upon which drywall or lay-in panels can be mounted. A typical "T" grid beam is an elongated beam with a flange at the bottom of the beam and a thicker "bulb" portion at the top end of the beam. Thus, the cross section of the beam resembles an inverted "T" shaped configuration. The bottom of the flange provides the grid face for the attachment of drywall, ceiling tiles, acoustical panels or other types of panels. Typically, these grid beams are made of extruded aluminum or roll-formed steel, and can be straight or curved.

Ceiling grid systems are typically suspended from a mounting surface, such as an exposed framing member, such as a joist, or an existing ceiling surface. The grid beams are typically suspended by a wire that is connected to the mounting surface and are arranged and attached to each other to form a rectangular patterned grid. Such suspended grid systems provide a means for lowering a ceiling surface to allow for the installation of utility fixtures, duct work, pipes, etc., above the ceiling surface. Access to such features is provided by the removal of one or more ceiling panels of the ceiling surface. The suspended grid system is also advantageous in that it allows easy replacement of a single panel if it becomes damaged, as opposed to replacing a complete section of a drywall or plaster ceiling. However, suspended ceiling grid systems have some disadvantages in certain applications. Many ceiling applications have space constraints, such as in a basement, where ceiling heights are typically less than standard construction ceiling heights. In these instances, suspended ceiling grid systems would suspend too low and minimize the height of the ceiling. Furthermore, many applications do not require an elaborate suspended grid system, which can be expensive due to the material requirements and labor requirements for installation. Therefore, a direct mount system for ceiling panels would minimize costs and maximize ceiling height.

Some prior art direct mount systems typically involve the direct application of panels or tile treatments to a ceiling mounting surface with adhesive, fasteners, screws, or other fastening means. Other prior art direct mount systems that utilize grid beams are not removable once a lower grid beam is assembled to an upper grid beam. These mounting arrangements make it difficult to replace sections of damaged ceiling panels. Furthermore, access to the space above the mounting surface from the inside of a room is often difficult due to the ceiling panels being positioned so close to the mounting surface. A panel must be lifted from the supporting ceiling grid and tilted for removal. The ceiling panel is obstructed from this movement because the mounting surface is too close to the back of the ceiling panel.

Therefore, it is an object of the present invention to provide a direct mount grid system that allows the installation of ceiling tiles close to the mounting surface thereby maximizing effective ceiling height of a room.

It is also an object of the present invention to provide a direct mount grid system having removable lower grid members to allow access to the space above the mounting surface after the ceiling has been installed.

It is also an object of the present invention to provide a direct mount grid system having removable lower grid members to allow replacement of damaged ceiling panels.

It is also an object of the present invention to provide a direct mount grid system that enables the use of standard lay-in ceiling panels.

These and other objects and advantages of the present invention will become apparent to those skilled in the art from the following description taken in conjunction with the drawings.

SUMMARY OF THE INVENTION

The present invention is a direct mount ceiling grid system that allows standard ceiling panels or tiles to be installed close to a mounting surface, typically ceiling joists. The invention uses base grid members, channel grid members, and cross grid members. The base grid members and the cross grid members are elongated beams having a generally T-shaped cross-section. The T-shape is formed by a base flange and a transversely extending web portion that extends from the base flange. The web portion has a thicker bulb portion along the length of its marginal end. The bulb portion has a generally annular cross-sectional shape providing a curved outer surface. The base flange of each base grid member is directly mounted to a mounting surface, such as a joist, by screws or other connecting means. The cross grid members are arranged in perpendicular fashion to the base grid members. The base flange of the cross grid members are slightly bent at each end of the cross grid member to provide an offset bearing surface wherein the ends of the cross grid members lay upon the base flange of a corresponding perpendicular channel grid member when it is assembled to a base grid member. The cross grid members are positioned such that the transversely extending web portion is directed upwardly from the base flange of the channel grid member. The base grid members and their corresponding channel grid members, and the cross grid members are arranged and mounted to form a generally rectangular grid pattern.

The channel grid members are elongated beams having a base flange and two transversely extending parallel webs extending from the base flange and forming a channel therebetween. The marginal ends of each web are bent inwardly and downwardly into the channel, forming a hook portion having a hook edge at each marginal end. Upon installation of ceiling panels, the channel of the channel grid members snaps over the bulb portion of the transversely extending web of the base grid members. The hooks of the parallel webs of the channel grid members deflect to capture the bulb portion. Once inserted, the hook edges abut against the curved outer surface of the bulb portion. The base flange of the base grid members and the base flange of the channel members capture the ceiling panels placed therebetween. The ceiling panels are also supported by the base flange of the cross grid members. This allows the ceiling panels to be positioned close to the mounting surface and disposes the panels in a common plane to form a ceiling.

The channel grid members are removable from the base grid members, thereby allowing easy replacement of damaged ceiling panels or direct access to the space above the mounting surface. When a downward force is applied to the channel grid member, the hook edges of the parallel webs follow around the outer curved surface of the bulb portion, thereby causing the parallel webs to deflect outwardly and release the bulb portion of the base grid member.

DETAILED DESCRIPTION OF THE INVENTION

Figure 1:
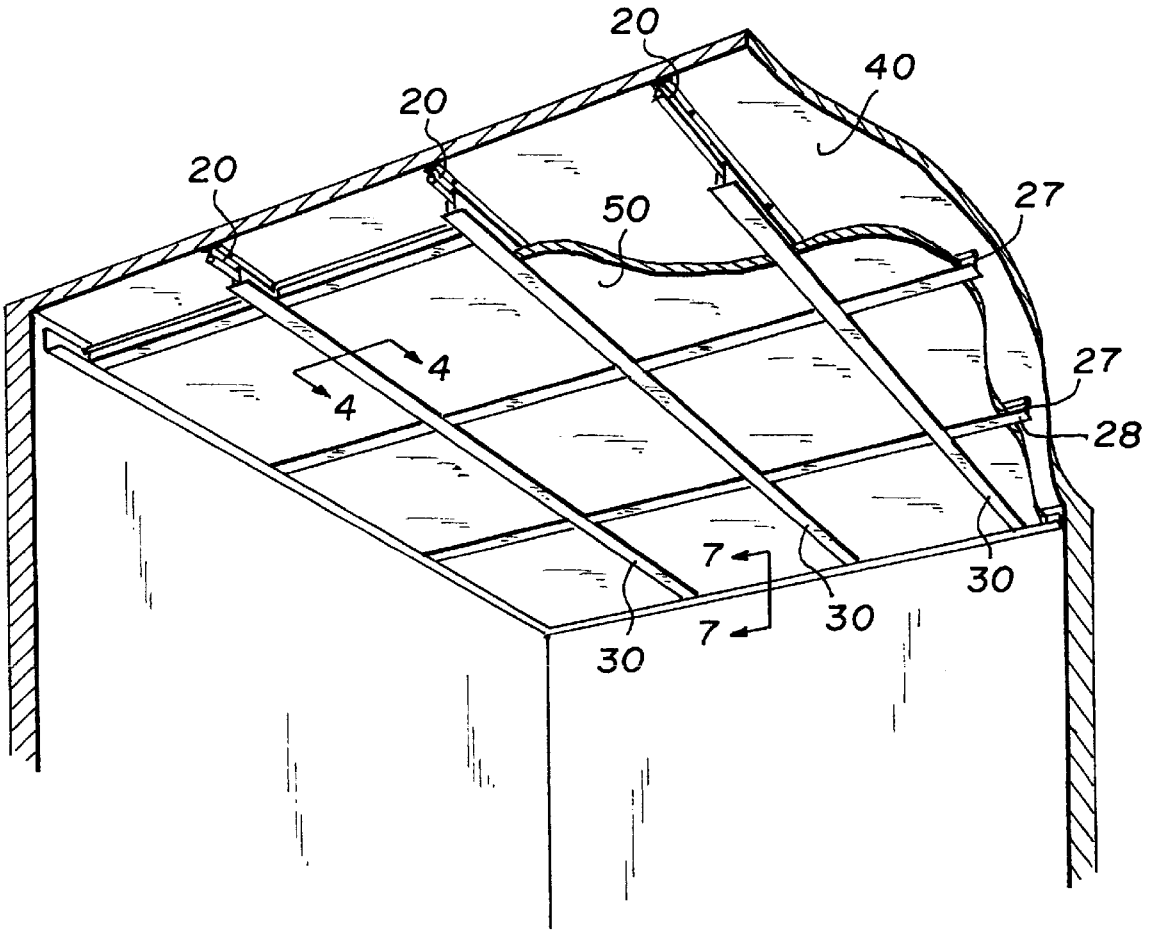
FIG. 1 is a perspective view of a direct mount ceiling panel grid system showing a plurality of base grid members, channel grid members, and cross grid members assembled with a plurality of ceiling panels to form a ceiling.

The present invention is a direct mount ceiling grid system comprising a plurality of base grid members 20, cross grid members 27, and channel grid members 30, as shown in FIG. 1. The grid system is used to mount ceiling panels 50 close to a mounting surface 40. The mounting surface can be any finished or unfinished ceiling surface, but typically comprises a plurality of ceiling joists. The base grid members 20 and the corresponding channel grid members 30 together form a two-piece snap-together grid. The cross grid members 27 are transversely disposed to the assembled base grid members 20 and the channel grid members 30 and provide further support to the ceiling panels 50, as shown in FIG. 1.

Figure 2:
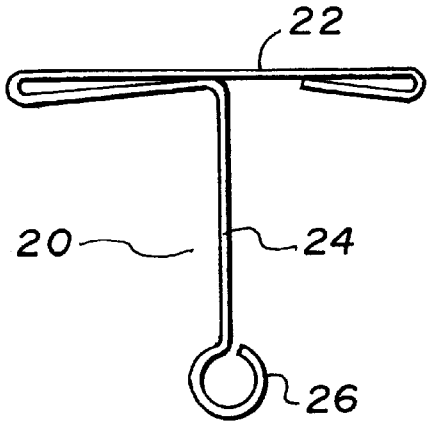
FIG. 2 is an elevational end view of a base grid member.
Figure 5:
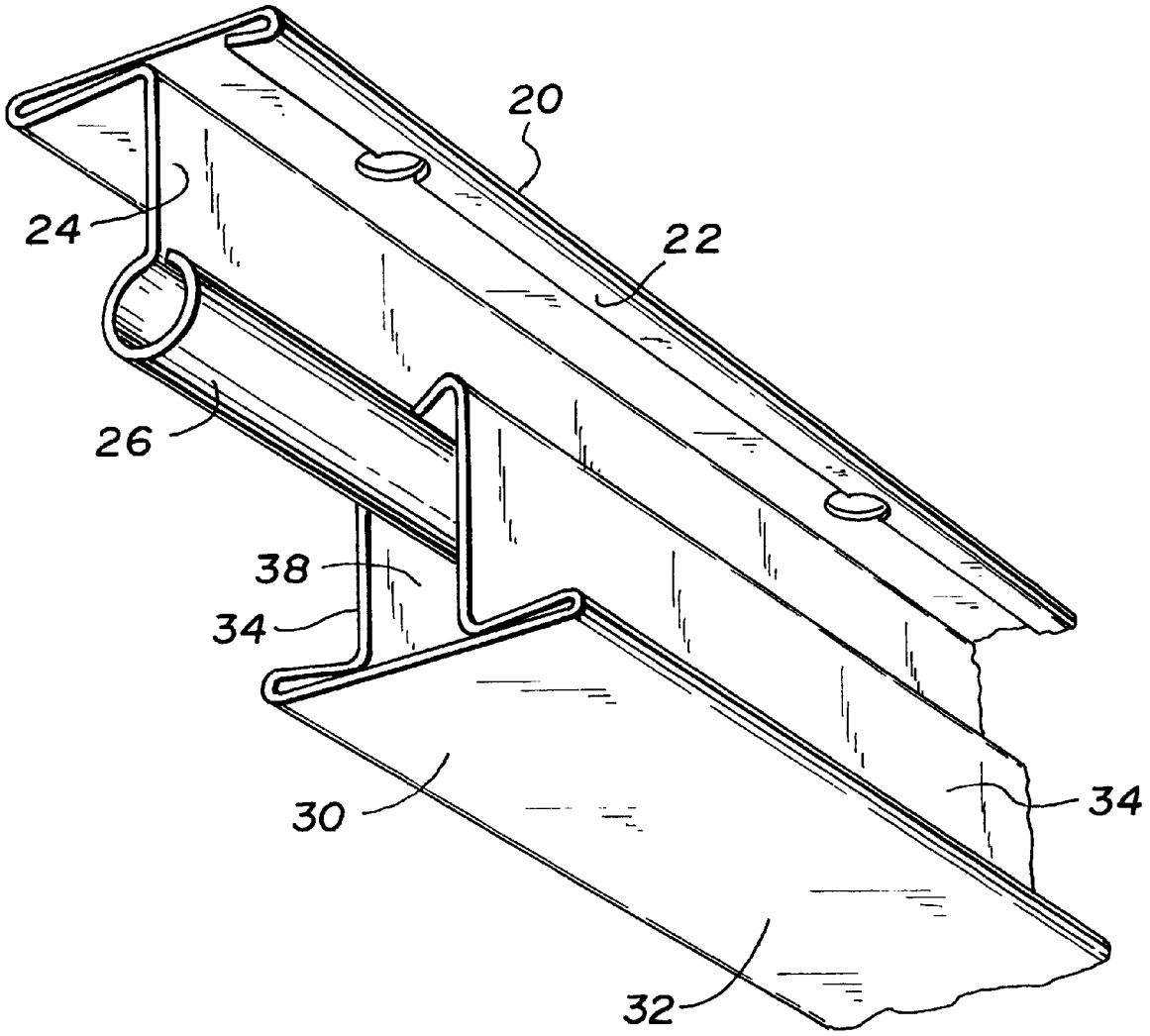
FIG. 5 is a perspective view of a base grid member engaged with a channel grid member of a direct mount ceiling panel grid system.

The base grid members 20 and the cross grid members 27 are elongated beams having a generally T-shaped cross-section, as shown in FIG. 2. The T-shape is formed by a base flange 22 and a transversely extending web portion 24 that extends from the base flange 22. The web portion 24 has a thicker bulb portion 26 along the length of its marginal end. The bulb portion 26 has a generally annular cross-sectional shape providing a curved outer surface, as shown in FIG. 2. In a preferred embodiment, the cross grid members 27 are generally of the same construction as the base grid members 20, but differ in position and orientation within the ceiling grid system, as shown in FIG. 1. The cross grid members also differ in that each cross grid member 27 has an offset bend at each end, as shown in FIG. 5, which provides an offset bearing surface 29.

Figure 3:
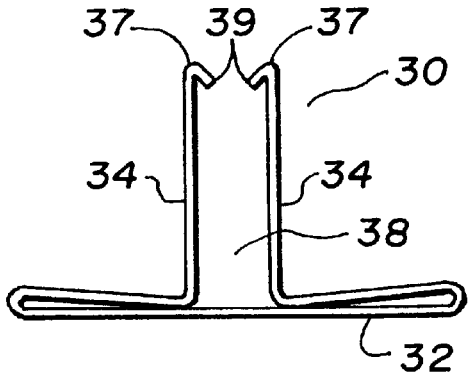
FIG. 3 is an elevational end view of a channel grid member.

The channel grid members 30 are designed to removably engage the bulb portion 26 of the base grid members 20. An end view of the channel member 30 is shown in FIG. 3. The channel grid members 30 are elongated beams having a base flange 32 and two transversely extending parallel webs 34 and 36 extending from the base flange 32 and forming a channel 38 therebetween. The marginal ends of the webs 34 and 36 are bent inwardly and downwardly into the channel 38, forming a hook portion 37 having a hook edge 39 on both webs 34 and 36. Thus, the channel 38 and the corresponding hook portions 37 are provided to accept and removably capture the bulb portion 26 of the base grid member 20.

Figure 4:
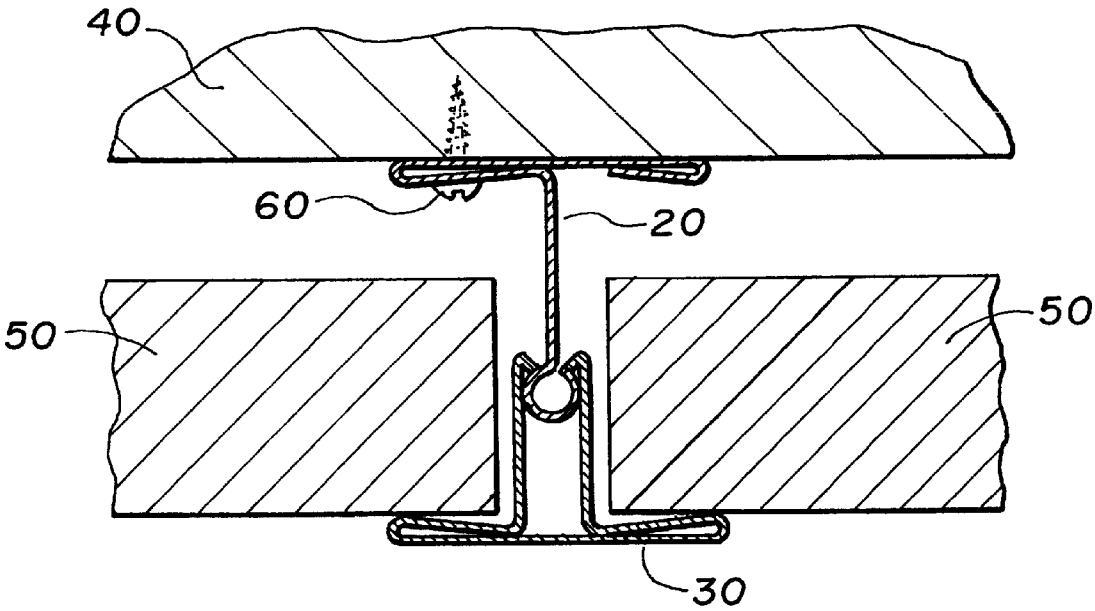
FIG. 4 is a detailed cross-sectional side view of FIG. 1 showing the base grid member mounted to a ceiling surface and engaged with a channel grid member supporting ceiling panels of a direct mount ceiling panel grid system.
Figure 6:
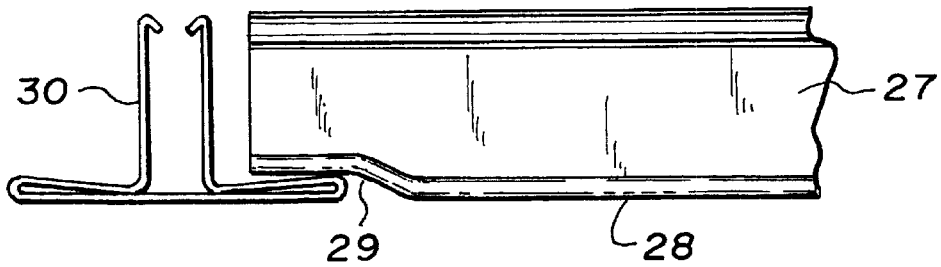
FIG. 6 is an elevational side view of a cross grid member transversely engaging a channel grid member.

The base flange 22 of each base grid member 20 is directly mounted to a mounting surface 40, such as the bottom surface of a joist, by screws 60 or other connecting means, as shown in FIG. 4. The screws 60 can engage the base flange 22 of the base grid member 20 on one side or both sides of the base flange 22 as defined by the transversely extending web portion 24. FIG. 4 shows the base flange 22 engaged by screw 60 on only one side. Upon installation of ceiling panels 50, the channel 38 of the channel grid members 30 snaps over the bulb portion 26 of the transversely extending web 24 of the base grid members 20, as shown in FIG. 5. The hook portions 37 of the parallel webs 34 and 36 of the channel grid members 30 deflect to allow capture of the bulb portion 26. Once inserted, the hook edges 39 abut against the bulb portion 26, as shown in FIG. 4. The base flange 22 of the base grid members 20 and the base flange 32 of the channel grid members 32 capture the ceiling panels 50 placed therebetween. The ceiling panels 50 are further supported by the base flange 28 of the cross grid members 27. The cross grid members 27 are arranged transverse to the base grid members 20 to form a generally rectangular grid pattern, as shown in FIG. 1. The cross grid members 27 are positioned such that the transversely extending web portion is directed upwardly from the base flange 32 of the channel grid member 30. The base flange 28 of the cross grid members 27 are slightly bent at each end of the cross grid member 27 to provide the offset bearing surface 29, as shown in FIG. 6. During installation, the offset bearing surface 29 of the cross grid members 27 are placed upon the base flange 32 of the channel grid member 30, thereby supporting the cross grid members 27.

Figure 7:
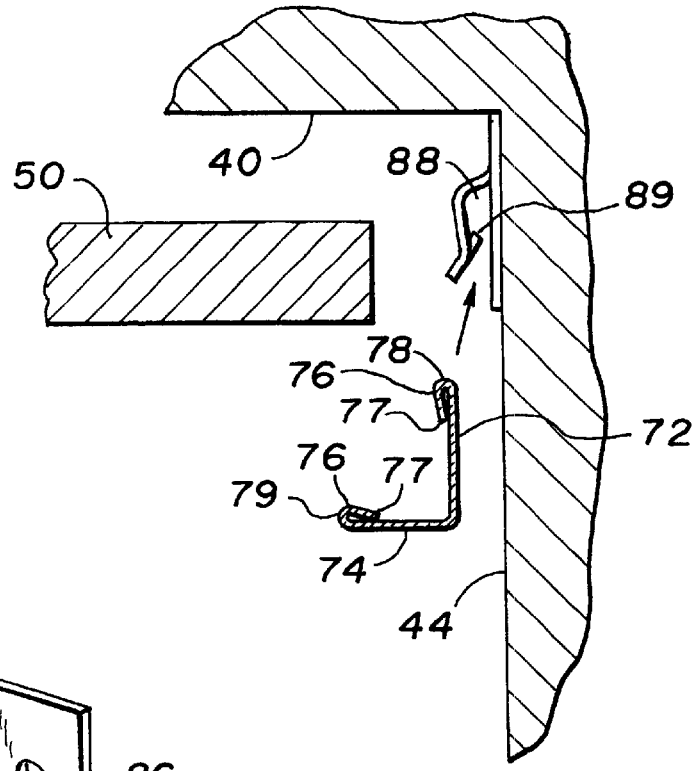
FIG. 7 is a detailed side elevational view of FIG. 1 showing a wall angle attachment clip of the grid system attached to a wall surface and indicating proper engagement with a wall angle for support of a ceiling panel at a terminal end of a ceiling surface at the wall surface.

An elongated "L" shaped wall angle beam 70 is used to support the ceiling panels 50 where the mounting surface 40 terminates at a wall surface 44, as shown in FIG. 7. The wall angle beam 70 is generally made of the same material and is formed in a similar manner as the base grid members 20 and channel grid members 30. The "L" shaped wall angle beam 70 has two leg portions 72 and 74 in transverse relation, thus forming the "L" shape of the wall angle beam 70. A hem 76 is formed along an outer edge 78 of the leg portion 72 and an outer edge 79 of the leg portion 74 of the wall angle beam 70. When the leg portion 72 of the wall angle beam 70 is abutted against the wall surface 44, the other leg portion 74 extends from the wall surface 44. The extending leg portion 74 supports the ceiling panels 50 at the wall surface 44.

Figure 8:
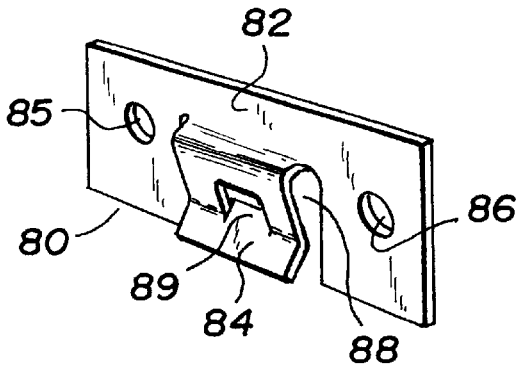
FIG. 8 is a perspective view of a wall angle attachment clip of the grid system.

The wall angle beam 70 is attached to the wall surface 44 by a wall angle attachment clip 80. The wall angle attachment clip 80 is attached to the wall surface 44 and provides a snap-fit engagement with the hem 76 of the leg portion 72 of the wall angle beam 70. The wall angle attachment clip 80 is a generally flat clip having a flat base portion 82 and a bent clip portion 84, as shown in FIG. 8. The flat base portion 82 has holes 85 and 86 therethrough for mounting to the wall surface 44 with mechanical fasteners, such as screws, nails, or the like. The bent clip portion 84 is integrally formed and bent from the flat base portion 82 of the attachment clip 80, thereby forming a clip channel 88. The bent clip portion 84 has a clip tab 89 formed therein that extends upwardly into the clip channel 88. The wall angle attachment clip 80 is mounted to the wall surface 44 such that the clip channel 88 formed by the bent clip portion 84 is oriented downwardly to accept the leg portion 72 of the wall angle 70, as shown in FIG. 7. When the leg portion of the wall angle is inserted into the clip channel, the clip tab engages the hem 76 and deflects the bent clip portion 84 outwardly. When the clip tab 89 passes a terminal edge 77 of the hem 76, the clip tab 89 snaps under the terminal edge 77 of the hem 76 causing the bent clip portion 84 to substantially return to its normal nondeflected position, while maintaining some deflection to hold the clip tab 89 against the wall angle 70. The hem 76 is thereby captured and held in place by the clip tab 89 of the bent clip portion 84.

Installation of the direct mount ceiling system allows the ceiling panels 50 to be positioned close to the mounting surface 40, as shown in FIG. 4. The system disposes the ceiling panels 50 in a common plane to form the ceiling. After installation is complete, the channel grid members 30 may be removed from the base grid members 20, thereby allowing easy replacement of damaged ceiling panels 50 or direct access to the space above the mounting surface 40. When a downward force is applied to the channel grid member 30, the hook edges 39 of the parallel webs 34 and 36 follow around the outer curved surface of the bulb portion 26, thereby causing the parallel webs 34 and 36 forming the channel 38 to deflect outwardly and release the bulb portion 26 of the base grid member 20. Removal of the channel grid members 30 in this manner allows access to the space above the ceiling panels 50 and removal of the ceiling panels 50 from below the ceiling.

Figure 9:
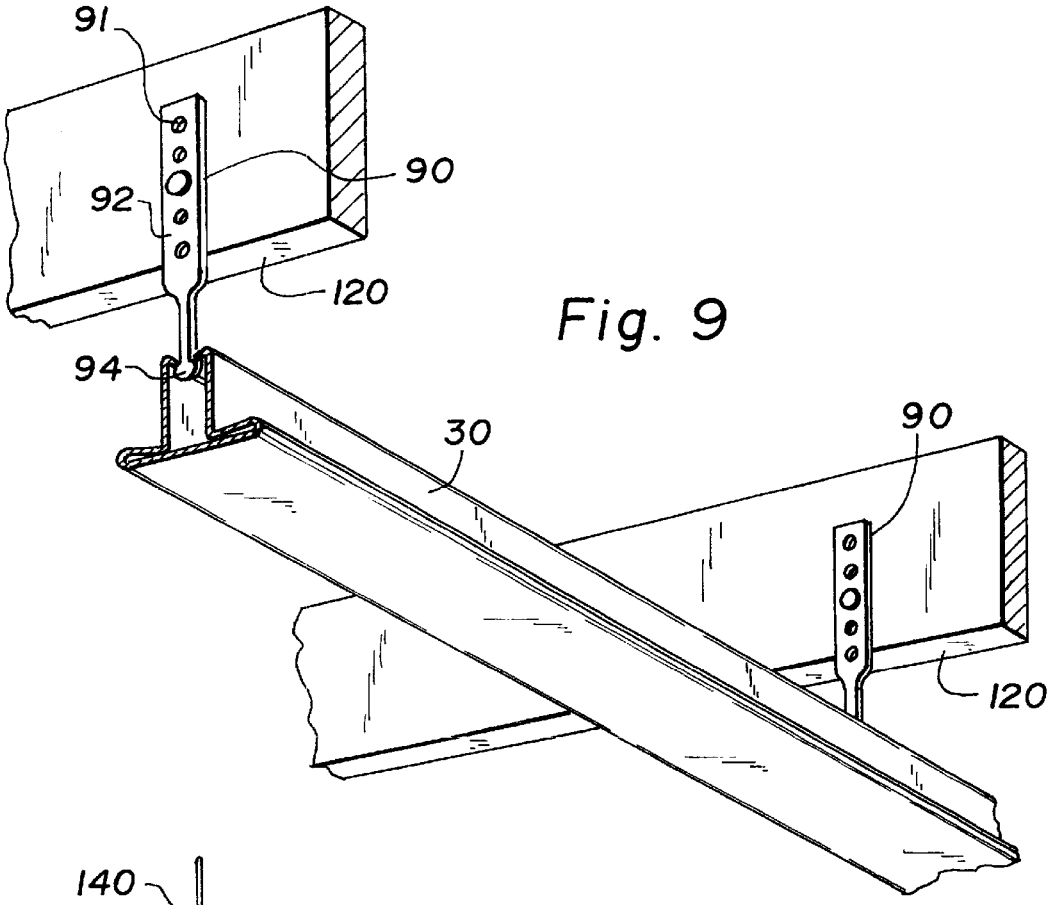
FIG. 9 is a perspective view of an alternate embodiment of the grid system, wherein a plurality of flat base straps each having an extending bulb portion at its end are utilized in lieu of an elongate base grid member.

An alternate embodiment of the grid system is shown in FIG. 9. In this configuration, a plurality of flat base straps 90 are used in lieu of the elongated base grid members 20. This configuration reduces material costs by eliminating the need for base grid members 20. The base strap 90 has a generally flat portion 92 and an extending bulb portion 94. The flat portion 92 is provided with holes 91 to be used for mounting the base strap to a joist 120 with mechanical fasteners, such as screws, nails, or the like. The base strap 90 is mounted to the joist 120 such that the extending bulb portion 94 depends downwardly from the joist 120, as shown in FIG. 9. A series of base straps 90 are mounted on a plurality of joists 120 and aligned to accept the elongated channel grid members 30 of the grid system. The channel members 30 removably snap over the bulb portions 94 of the base straps 20 in the same fashion as in the preferred embodiment.

Figure 10:
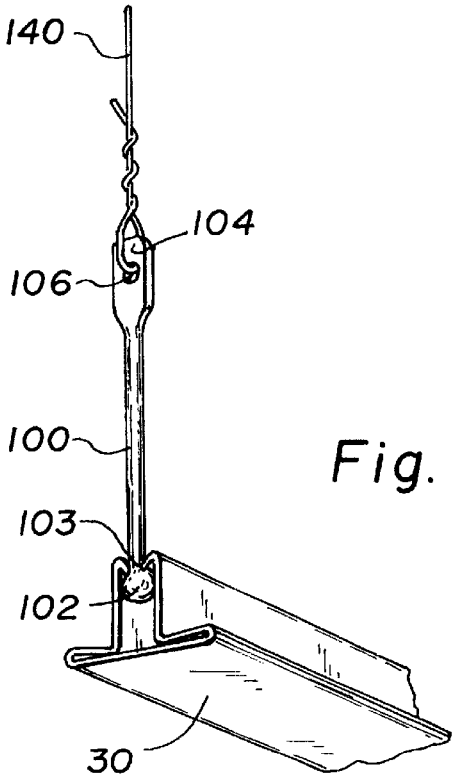
FIG. 10 is a perspective view of another alternate embodiment of the grid system, wherein a plurality of suspension rods each having an enlarged head at its end are utilized in lieu of an elongate base grid member.

Another alternate embodiment is shown in FIG. 10. In this configuration, a plurality of suspension rods 100 are used in lieu of the elongated base grid members 20. The suspension rods 100 are generally cylindrical having an enlarged circular head 102 at one end of the suspension rod 100 and a flat tab 104 at the other end of the suspension rod 100. The flat tab 104 has a hole 106 therethrough so that a suspension wire 140 can be inserted through the hole 106 and secured to the suspension rod 100. The wire is then attached to the mounting surface 40 so that the suspension rod 100 suspends from the mounting surface 40. The suspension rod 100 can also be directly mounted to the mounting surface 40 or a joist by fastening the flat tab 104 to the mounting surface 40 or joist with a mechanical fastener, such as a screw, nail, or the like. The enlarged head 102 at the other end of the suspension rod 100 is of a generally circular configuration similar to a head on a nail. A tapering radial surface 103 is located below the enlarged head 102 and tapers into the outer cylindrical surface of the suspension rod 100. The radial surface 103 provides for the removable engagement of the channel member 30 with the enlarged head 102 of the suspension rod 100, similar to the bulb portion 26 in the preferred embodiment. A series of suspension rods 100 are suspended from the mounting surface 40 or joists and aligned to accept the elongated channel grid members 30 of the grid system. The channel members 30 removably snap over the enlarged heads 102 of the suspension rods 100 in similar fashion as in the preferred embodiment.

While specific embodiments of the present invention have been shown here for the purposes of explaining preferred and alternate embodiments of the invention, it is to be understood that the appended claims have a wide range of equivalents and a broader scope than the embodiments disclosed.

What is claimed is:

1. A direct mount ceiling panel grid system installing a plurality of ceiling panels close to a mounting surface comprising:

a plurality of base grid members each having a T-shaped cross-section formed by a base flange portion and a transversely extending web portion, the transversely extending web portion defining two sides of the web portion and having a relatively thicker bulb portion at its transversely extending marginal end, the bulb portion having a predominantly annular cross-section thereby providing a curved outer surface, the base flange portion directly mounted to the mounting surface such that the web portion depends downwardly;

a plurality of channel grid members each having a base flange and two transversely extending parallel webs forming a channel therebetween, each of the webs having a hooked portion bent inwardly and downwardly into the channel along its marginal end, thereby providing a hook edge, the channel removably and frictionally fitted over the bulb portion of the transversely extending web portion of the base grid members whereby the hooked portions of the parallel webs of the channel grid members capture the bulb portion with the hook edges abutted against the curved outer surface of the bulb portion, the base flange portion of the grid members and the base flange portion of the channel members capturing the ceiling panels placed therebetween so that the ceiling panels are positioned in a common plane adjacent to the mounting surface.

2. The direct mount ceiling panel grid system of claim 1, further comprising a plurality of cross grid members, each cross grid member having a bearing surface at both of its ends, at least one bearing surface of each cross grid member disposed upon the base flange of at least one channel grid member and positioned transverse to the channel grid members.

3. The direct mount ceiling panel grid system of claim 1, wherein the channel grid members, base grid members, and cross grid members are integrally formed from metal.

4. The direct mount ceiling panel grid system of claim 1, wherein the ceiling panels are acoustical ceiling panels.

5. The direct mount ceiling panel grid system of claim 1, wherein the base flanges of the base grid members are mechanically fastened to the mounting surface on one side of the web portion.

6. The direct mount ceiling panel grid system of claim 1, wherein respective base grid members and channel grid members are elongate and substantially linearly co-extensive.

7. The direct mount ceiling panel grid system of claim 1, further comprising an L-shaped wall angle beam for supporting ceiling panels at a wall surface transverse to the mounting surface, the wall angle having two leg portions forming an inside angle therebetween, one of the leg portions attached to the wall surface such that the other leg portion transversely extends from the wall surface and supports a ceiling panel placed thereon below the mounting surface.

8. The direct mount ceiling panel grid system of claim 7, wherein each leg portion has a hem along its marginal edge, the hem bent inwardly toward the inside angle of the L-shaped wall angle.

9. The direct mount ceiling panel grid system of claim 8, wherein the wall angle is attached to the wall surface with an attachment clip having a bent clip portion and a flat base portion, the bent clip portion defining a channel portion of the clip, the bent clip portion having a clip tab extending upwardly into the channel portion such that the clip tab engages the hem of one of the leg portions of the wall angle when the leg portion is inserted into the channel portion of the attachment clip.

10. A direct mount ceiling panel grid system installing a plurality of ceiling panels close to a mounting surface comprising:

a plurality of base straps each having a generally flat portion and an extending neck portion, the neck portion having a relatively thicker bulb portion at its marginal end, the bulb portion having a predominantly annular cross-section thereby providing a curved outer surface, the flat portion of the base strap directly mounted to the mounting surface such that the neck portion depends downwardly;

a plurality of channel grid members each having a base flange and two transversely extending parallel webs forming a channel therebetween, each of the webs having a hooked portion bent inwardly and downwardly into the channel along its marginal end, thereby providing a hook edge, the channel removably and frictionally fitted over the bulb portion of the neck portion of the base strap whereby the hooked portions of the parallel webs of the channel grid members capture the bulb portion with the hook edges abutted against the curved outer surface of the bulb portion, the base flange portion of the channel grid members supporting the ceiling panels placed thereon so that the ceiling panels are positioned in a common plane adjacent to the mounting surface.

11. A direct mount ceiling panel grid system comprising:

a plurality of suspension rods each having a flat tab at one end and an enlarged head at the other end of the rod, the enlarged head having a tapered curved surface between the enlarged head and the rod, the base flange portion mounted to the mounting surface such that the enlarged head depends downwardly;

a plurality of channel grid members each having a base flange and two transversely extending parallel webs forming a channel therebetween, each of the webs having a hooked portion bent inwardly and downwardly into the channel along its marginal end, thereby providing a hook edge, the channel removably and frictionally fitted over the enlarged head of the transversely extending web portion of the base grid members whereby the hooked portions of the parallel webs of the channel grid members capture the enlarged head with the hook edges abutted against the tapered curved surface of the enlarged head, the base flange portion of the channel grid members supporting the ceiling panels placed thereon so that the ceiling panels are positioned in a common plane adjacent to the mounting surface.

12. A method of installing a direct mount ceiling grid system comprising the steps of:

mounting a plurality of base grid members, each having a T-shaped cross-section formed by a base flange portion and a transversely extending web portion having a bulb portion with a curved outer surface, to a mounting surface such that the base grid members are parallel to each other and the transversely extending web portion depends downwardly from the mounting surface;

positioning a plurality of channel grid members, each having a base flange and a channel with inwardly and downwardly extending hook portions, in alignment with the base grid members and engaging the channel over the bulb portion such that the hook portions engage the curved outer surface of the bulb portion;

arranging a plurality of cross grid members each having a base flange portion and two ends having a bearing surface, in transverse relation to the base grid members and placing at least one bearing surface of the cross grid members upon the base flange of at least one of the channel grid members.

* * * * *